United States Patent [19]

Walfridson et al.

[11] Patent Number: 4,914,919

[45] Date of Patent: Apr. 10, 1990

[54] ARRANGEMENT FOR PREVENTING FREEZING OF THE WORKING MEDIUM IN AN ABSORPTION REFRIGERATING APPARATUS

[75] Inventors: Magnus T. Walfridson, Sollentuna; Stig H. Färndahl, Farsta, both of Sweden

[73] Assignee: Aktiebolaget Electrolux, Stockholm, Sweden

[21] Appl. No.: 294,111

[22] Filed: Jan. 6, 1989

[30] Foreign Application Priority Data

Jan. 8, 1988 [SE] Sweden ..... 8800041

[51] Int. Cl.[4] ..... F25B 27/00

[52] U.S. Cl. ..... 62/236; 62/148; 62/476

[58] Field of Search ..... 62/236, 237, 476, 148

[56] References Cited

U.S. PATENT DOCUMENTS 3,771,320 11/1973 Kenneryd et al. ..... 62/476 X 4,656,837 4/1987 Blomberg ..... 62/236

*Primary Examiner*—Lloyd L. King

*Attorney, Agent, or Firm*—Pearne, Gordon, McCoy & Granger

[57] ABSTRACT

The invention refers to an arrangement at a refrigerator cabinet (10) having an absorption refrigerating apparatus (16,18) operated by a heating cartridge (40) from at least one electric current source or by a gas burner (38). The arrangement shows a control apparatus (74) which automatically starts the gas burner (38) when the supply of current to the heating cartridge (40) ceases. The refrigerating apparatus (18) is with exception of its evaporator (16) enclosed in a heat insulated chamber (20) through which surrounding air circulates for cooling of the refrigerating apparatus (18). In order to prevent the refrigerant in the refrigerating apparatus from freezing to plugs at low temperature of the surrounding air, which plugs put the refrigerating apparatus out of function, means (86) are arranged to limit the air circulation through the chamber (20) and a temperature sensing means (80) is located in the chamber for breaking the current to the heating cartridge (40) at a certain low temperature in the chamber (20) so that the gas burner (38) is put into operation.

3 Claims, 1 Drawing Sheet

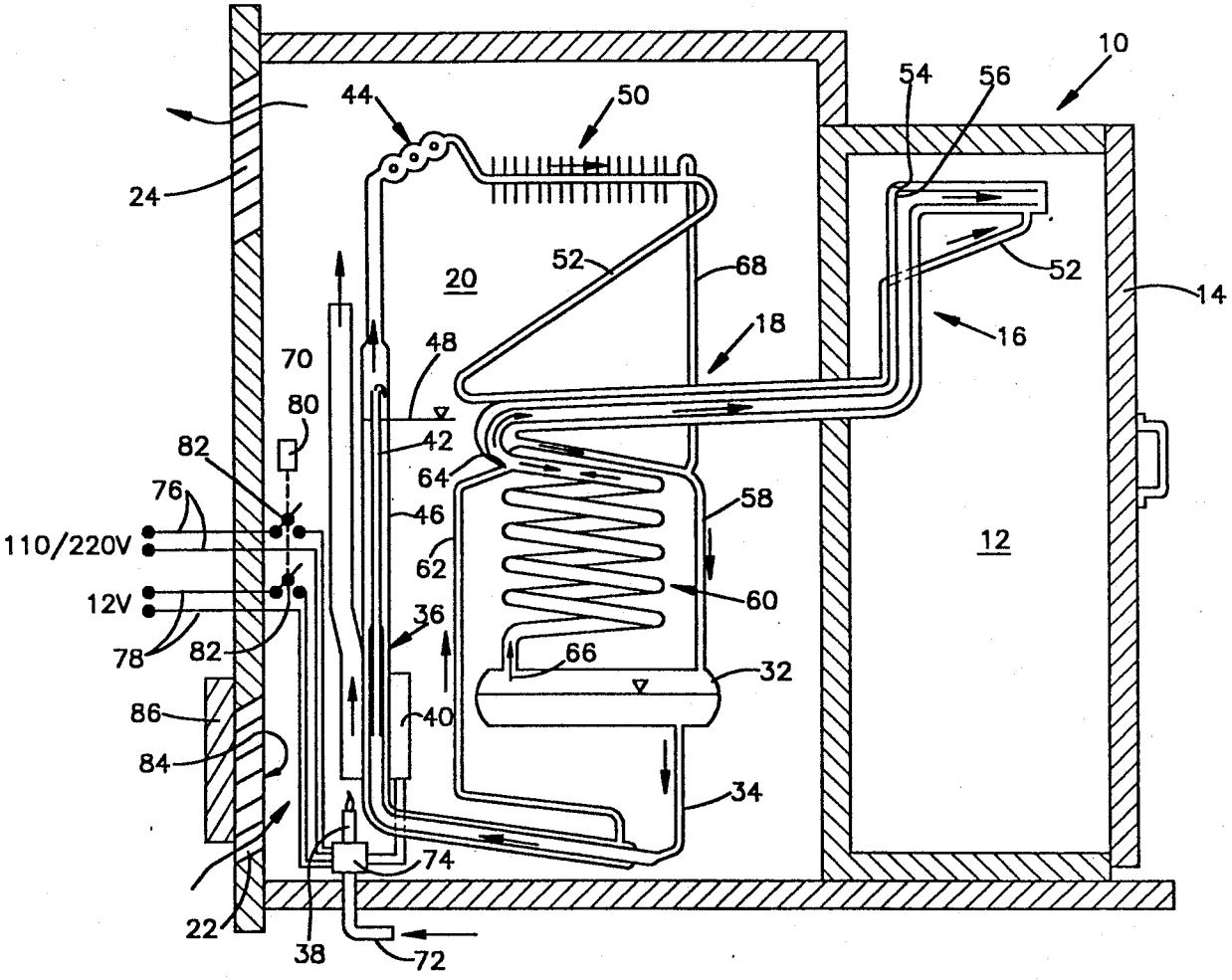
10
14
12
16
52
56
54
18
68
58
60
32
34
50
52
66
20
48
42
64
46
62
36
40
74
72
44
38
70
80
82
76
110/220V
12V
78
86
84
22
24

ARRANGEMENT FOR PREVENTING FREEZING OF THE WORKING MEDIUM IN AN ABSORPTION REFRIGERATING APPARATUS

The invention relates to an arrangement at a refrigerator cabinet having an absorption refrigerating apparatus operated by a heating cartridge from at least one electric current source or by a gas burner, the arrangement showing a control apparatus which automatically starts the gas burner when the supply of current to the heating cartridge ceases and the refrigerating apparatus with exception of its evaporator is enclosed in a heat insulated chamber through which surrounding air circulates for cooling of the refrigerating apparatus.

Such an arrangement is known when an absorption refrigerating apparatus according to U.S. Pat. No. 3,771,320 is arranged to be operated by electricity or gas according to U.S. Pat. No. 4,656,837.

U.S. Pat. No. 3,771,320 shows an absorption refrigerating apparatus which with exception of its evaporator is enclosed in a heat insulated chamber through which ambient air circulates for cooling of the refrigerating apparatus. When such a refrigerating apparatus contains ammonia, water and hydrogen as the working medium and the temperature is lower than −12° C. of the parts of the refrigerating apparatus located in the chamber, the medium in certain parts of the apparatus will freeze to plug the system which prevents the circulation of the medium through the apparatus, the apparatus thereby ceasing to function as a refrigerating apparatus.

U.S. Pat. No. 4,656,837 shows an absorption refrigerating apparatus operated either by 12 volt from an automobile generator, by 110 volt from the electric mains or by gas from a gas burner. A control apparatus sees to it that the refrigerating apparatus always is operated by the most advantageous available kind of energy. The control apparatus solves this task automatically in that it lets the refrigerating apparatus be operated by the electric mains, secondly by the generator and thirdly by the gas.

The object of the invention is to prevent the absorption refrigeration apparatus set forth from being put out of operation by the medium in the apparatus freezing to plug the system at low temperatures of the ambient air.

This object is obtained through the arrangement according to the invention by means for limiting the air circulation through the chamber and by temperature sensing means located in the chamber for interrupting the current to the heating cartridge at a certain low temperature in the chamber so that the gas burner is put into operation.

By the means for limiting the air circulation through the chamber, the temperature in the chamber will be raised in relationship to the temperature of the outdoor air, which contributes to prevent freezing of the medium in the refrigerating apparatus. These measures are not, however, sufficient when the apparatus is started by electricity via a heating cartridge when the apparatus has been switched off for a longer time in a low ambient temperature. The power of the heating cartridge is too low in order that the heat from the heating cartridge within reasonable time shall manage to spread through the apparatus and melt frozen plugs.

If the apparatus, however, is started by the gas burner, the heat from the burner will rapidly melt frozen plugs because in an absorption refrigerating apparatus a gas burner gives off about 3 times more heat than an electric heating cartridge in order that the boiler of the refrigerating apparatus shall be supplied with as much heat from the gas burner as from the heating cartridge. The temperature sensing means assures that the refrigeration apparatus rapidly will come into operation thereby causing the gas burner to be put into operation when it is so cold in the chamber that freezing can be expected in the refrigerating apparatus.

An embodiment of an arrangement according to the invention is described in the enclosed drawing, the FIGURE of which shows a sectional view of a caravan provided with an absorption refrigerating apparatus.

A refrigerator cabinet referred to generally by the reference numeral 10 contains a refrigerated space 12, which is closable by a door 14. The space 12 is cooled by the evaporator 16 of an absorption refrigerating apparatus 18 located behind the cabinet 10 in a heat insulated chamber 20. The refrigerating apparatus 18 is cooled by ambient air entering the chamber 20 through a lower opening 22 and leaving the chamber 20 through an upper opening 24.

The refrigerating apparatus 18, which is of a known kind, e.g. through FIG. 3 of U.S. Pat. No. 4,691,529, shows an absorber vessel 32 containing an absorption liquid, such as water, in which a refrigerant, such as ammonia, is dissolved. This solution, which is relatively rich in refrigerant, is called a rich solution. The rich solution exits from the absorber vessel 32 through a conduit 34 and enters a boiler 36 in which the rich solution is supplied with heat from a gas burner 38 or from a 110 or 220 volt electric heating cartridge 40, or from a 12 volt electric heating cartridge (not shown). The refrigerant vapor boils off from the rich solution which thereby becomes a so-called weak solution. The mixture of refrigerant vapor and weak solution is expelled through a pump pipe 42, the refrigerant vapor continuing to a separator 44 which separates out absorption liquid accompanying the refrigerant vapor and the weak solution being collected in an outer pipe 46 of the boiler 36 to a certain level 48.

The refrigerant vapor flows from the separator 44 into a condenser 50, where heat is transferred from the vapor to the air in the chamber 20 so that the vapor condenses. The refrigerant condensate leaves the condenser through a conduit 52 and enters the evaporator 16, where the condensate meets a flow of an inert gas, such as hydrogen, and is vaporized in an outer pipe 54 in the inert gas during absorption of heat from the space 12. The inert gas is supplied to the evaporator 16 through an inner pipe 56 which is located within the outer pipe 54 and the mixture of inert gas and vaporized refrigerant exits from the evaporator 16 through the pipe 54 and continues via a pipe 58 to the absorber vessel 32.

From the absorber vessel 32, the mixture of refrigerant vapor and inert gas is elevated through an absorber 60 and meets the weak solution, which, driven by the level 48, comes from the pipe 46 via a conduit 62 into the upper part of the absorber 60 at 64. While flowing downwards through the absorber 60, the weak solution absorbs refrigerant vapor flowing upwards during rejection of heat to the air in the chamber 20, the weak solution thereby becoming a rich solution again before it flows down into the absorber vessel 32 at 66. The elevating inert gas continues from the absorber 60 to the pipe 56 and enters after that into the evaporator 16 and permits the refrigerant condensate to vaporize in it.

In order to prevent refrigerant vapor, which possibly does not condensate in the condenser, from collecting in the condenser and blocking the outflow of refrigerant condensate from the condenser, a vent conduit 68 is arranged between the outlet of the condenser 50 and the conduit 58, which conduit 68 leads gaseous medium to the absorber vessel 32.

The burner 38 heats the boiler 36 via a pipe 70 through which the hot flue gas from the burner passes. By means of a conduit 72 gas is supplied to the burner 38 via a control apparatus 74. Conduits 76 with 110 or 220 volt originate from the electric mains for operating the heating cartridge 40 and conduits 78 and 12 volt originating from an automobile generator for operating the heating cartridge not shown are also connected to the control apparatus 74. As previously mentioned, the control apparatus is such that it automatically puts into operation the current originate from the automobile generator if the supply of current from the electric mains ceases. If the supply of current from the automobile generator also ceases, the control apparatus automatically puts the refrigeration into operation by gas.

A temperature sensing means 80 is located in the chamber 20. The means 80 is connected to switches 82 in the conduits 76 and 78 and is arranged to interrupt the current through said conduits at a certain low temperature in the chamber 20 at which it is expected that the medium in the refrigerating apparatus 18 freezes to plug the system which causes the apparatus to be inoperative. The weak solution, e.g. in the conduit 62, is the first to freeze.

When it is so cold that freezing in the refrigerating apparatus is to be expected the larger part of a lower vent grid 84 is covered by a plate 86, so that only a small opening 22 is left for letting in air into the chamber 20. By this the circulation of air through the chamber 20 is limited, so that the chamber can better maintain the heat which is generated by the refrigerating apparatus 18 in the chamber 20.

Below a certain low temperature, e.g. −12° C., in the chamber 20, the temperature sensing means 80 disconnects the electric operation of the refrigerating apparatus, whereby the gas burner is automatically put into operation. The gas burner, which gives off about 3 times as much heat as any of the electric heating cartridges can give off, will rapidly heat the chamber 20 and the refrigerating apparatus 18 so that frozen plugs are melted.

The invention is suitable for use with a caravan which is parked in a winter sports place with the refrigerating apparatus connected to the electric mains. Under these circumstances it is sufficient to arrange the switch 82 solely in the conduits 76, as the automobile generator normally does not generate current when the caravan is parked. The temperature sensing means 80 and the switch 82 are suitably constructed as a unit which is located in the chamber 20 and which is connected solely to the conduits 76 or to the conduits 76 and the conduits 78, as well as is shown in the FIGURE.

We claim:

1. In a refrigerator cabinet arrangement having an absorption refrigerating apparatus, an electric heating cartridge and a gas burner, a control apparatus which automatically starts the gas burner when the supply of current to the heating cartridge ceases, said refrigerating apparatus with the exception of its evaporator being enclosed in a heat insulated chamber in which surrounding air circulates to cool the refrigerating apparatus, the improvement comprising adjustable means for limiting the air circulation in said chamber, and temperature sensing means located in said chamber for interrupting the current flow to said cartridge at a predetermined low temperature in the chamber so that the gas burner can be made operative.

2. In a refrigerator cabinet arrangement having an absorption refrigerating apparatus, an electric heating cartridge and a gas burner, a control apparatus which automatically starts the gas burner when the supply of current to the heating cartridge ceases, said refrigerating apparatus with the exception of its evaporator being enclosed in a heat insulated chamber in which surrounding air circulates to cool the refrigerating apparatus, the improvement comprising means for limiting the air circulation in said chamber, temperature sensing means located in said chamber for interrupting the current flow to said cartridge at a predetermined low temperature in the chamber so that the gas burner can be made operative, and a lower vent grid in said chamber wherein said means for limiting air circulation in said chamber is a movable plate for changing the number of grid openings thereby controlling the mount of ambient air admitted to said chamber.

3. In a refrigerator cabinet arrangement having an absorption refrigerating apparatus, an electric heating cartridge and a gas burner, a control apparatus which automatically starts the gas burner when the supply of current to the heating cartridge ceases, said refrigerating apparatus with the exception of its evaporator being enclosed in a heat insulated chamber in which surrounding air circulates to cool the refrigerating apparatus, the improvement comprising means for limiting the air circulation in said chamber, temperature sensing means located in said chamber for breaking the current flow to said cartridge at a predetermined low temperature in the chamber so that the gas burner can be made operative, and electrical conduits having switches connecting said heating cartridge to said temperature sensing means.

* * * * *

UNITED STATES PATENT AND TRADEMARK OFFICE

CERTIFICATE OF CORRECTION

PATENT NO. : 4,914,919

DATED : April 10, 1990

INVENTOR(S) : Magnus T. Walfridson and Stig H. Farndahl

It is certified that error appears in the above-identified patent and that said Letters Patent is hereby corrected as shown below:

Column 1, line 6, delete "at" and insert --in--.

Column 1, line 38, after "at" insert --initially--.

Column 3, line 13, delete "and" and insert --with--.

Column 3, line 13 and 14, delete "volt" and insert --volts--.

Column 3, line 18, delete "originate" and insert --originating--.

Column 3, line 21, delete "puts the refrigeration into operation by gas" and insert --activates the gas burner thereby maintaining operation of the refrigerator absorption unit--.

Column 3, line 33, after "expected" insert --,--.

Column 4, line 4, delete "FIGURE" and insert --figure--.

Signed and Sealed this

Third Day of September, 1991

*Attest:*

*Attesting Officer*

HARRY F. MANBECK, JR.

*Commissioner of Patents and Trademarks*